US007143964B2

(12) United States Patent
Kuegler

(10) Patent No.: US 7,143,964 B2
(45) Date of Patent: Dec. 5, 2006

(54) FUEL INJECTION VALVE FOR INTERNAL COMBUSTION ENGINES

(75) Inventor: Thomas Kuegler, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/534,144

(22) PCT Filed: Oct. 31, 2003

(86) PCT No.: PCT/DE03/03624

§ 371 (c)(1),
(2), (4) Date: Dec. 12, 2005

(87) PCT Pub. No.: WO2004/044415

PCT Pub. Date: May 27, 2004

(65) Prior Publication Data

US 2006/0118660 A1 Jun. 8, 2006

(30) Foreign Application Priority Data

Nov. 11, 2002 (DE) ..... 102 52 660

(51) Int. Cl.
*F02M 61/00* (2006.01)

(52) U.S. Cl. ..... 239/533.12; 239/533.11; 239/533.4; 239/533.3; 239/88; 123/467

(58) Field of Classification Search ..... 239/533.2, 239/533.3, 533.4, 533.11, 533.12, 585.2, 239/88, 90, 91; 123/467
See application file for complete search history.

(56) References Cited

U.S. PATENT DOCUMENTS 1,834,061 A * 12/1931 Joachim ..... 239/410
4,151,958 A * 5/1979 Hofmann ..... 239/533.3
4,202,500 A * 5/1980 Keiczek ..... 239/533.3
5,899,389 A * 5/1999 Pataki et al. ..... 239/533.2
6,024,297 A * 2/2000 Greeves ..... 239/96
6,616,070 B1 9/2003 Kunkulagunta

FOREIGN PATENT DOCUMENTS

| | | |
|---|---|---|
| DE | 198 34 867 | 2/1999 |
| DE | 19834867 | 2/1999 |
| DE | 100 58 153 | 6/2002 |
| EP | 0470348 | 2/1992 |
| EP | 0520659 | 12/1992 |
| EP | 1063417 | 12/2000 |
| EP | 1136693 | 3/2001 |
| FR | 2328855 | 5/1977 |
| WO | 03040543 | 5/2003 |

* cited by examiner

*Primary Examiner*—Dinh Q. Nguyen
(74) *Attorney, Agent, or Firm*—Michael J. Striker

(57) ABSTRACT

A fuel injection valve for internal combustion engines includes a valve body (1) in which a bore (5) is defined in one end, in which a first row of injection openings (20) and a second row of injection openings (22) are formed. In the bore (5), an outer valve needle (8) cooperates with the valve seat (18) for controlling the first row of injection openings (20); between the outer valve needle (8) and the wall of the bore (5), a pressure chamber (14) is formed. In the outer valve needle (8), an inner bore (11) is formed, in which an inner valve needle (10) is located and which cooperates with the valve seat (18) for controlling the second row of injection openings (22). A pressure shoulder (30) is formed on the inner valve needle. A hydraulic opening force is exerted on the inner valve needle (10); by its opening stroke, the outer valve needle (8) opens a throttle connection (32) from the pressure chamber (14) to the pressure shoulder (30) of the inner valve needle (10).

6 Claims, 5 Drawing Sheets

FUEL INJECTION VALVE FOR INTERNAL COMBUSTION ENGINES

CROSS-REFERENCE

The invention described and claimed hereinbelow is also described in PCT/DE 2003/03624, filed Oct. 31, 2003 and DE 102 52 660.5, filed Nov. 11, 2002. This German Patent Application, whose subject matter is incorporated here by reference, provides the basis for a claim of priority of invention under 35 U.S.C. 119 (a)–(d).

BACKGROUND OF THE INVENTION

The invention is based on a fuel injection valve for internal combustion engines, of the kind known for instance from German Patent Disclosure DE 100 58 153 A1. The fuel injection valve shown there has a valve body in which a bore is embodied. On its end toward the combustion chamber, the bore is defined by a valve seat, in which a first row of injection openings and a second row of injection openings, the latter located on the combustion chamber side of the former, are embodied; the injection openings of both rows of injection openings discharge into the combustion chamber of the engine. an outer valve needle is located longitudinally displaceably in the bore and is guided in the bore in a portion facing away from the combustion chamber. Between the outer valve needle and the wall of the bore, a pressure chamber is embodied that can be filled with fuel at high pressure. On its end toward the combustion chamber, the outer valve needle has a valve sealing face, with which it cooperates with the valve seat for controlling the first row of injection openings. Centrally along its longitudinal axis, an inner bore extends in the outer valve needle, and an inner valve needle is located longitudinally displaceably in the inner bore. On its end toward the combustion chamber, the inner valve needle has a sealing face, with which is cooperates with the valve seat and thereby controls the opening of the second row of injection openings. The opening force on the inner valve needle is generated by exerting pressure on a pressure face, which after the outer valve needle has lifted is acted upon by the fuel pressure of the annular chamber.

If the outer valve needle and the inner valve needle are opened successively, then once the outer valve needle has lifted from the valve seat fuel pressure from the pressure chamber flows inward and there strikes the inner valve needle, which until then was separated from the pressure chamber. If suddenly the entire pressure face of the inner valve needle is now acted upon by the pressure in the pressure chamber, this force impact can cause an unwanted slight lifting of the inner valve needle before such lifting is wanted from the standpoint of the injection course. This causes an imprecise injection and an increase in pollutant emissions from the engine.

SUMMARY OF THE INVENTION

The fuel injection valve of the invention has the advantage over the prior art that the inner valve needle does not, uncontrolled, open the injection openings assigned to it before the intended time for doing so. The opening force on the inner valve needle does not build up, after the opening of the outer valve needle, until after a certain time lag. For this purpose, the pressure face of the inner valve needle can be made to communicate with the pressure chamber via a throttle connection, which leads to the aforementioned delay in building up the opening pressure.

In a first advantageous feature of the subject of the invention, the throttle connection is embodied as an annular gap between the wall of the inner bore and the inner valve needle, on the end of the outer valve needle toward the combustion chamber. This embodiment of the throttle connection is easy to embody and moreover means that the inner valve needle cannot become stuck in the inner bore of the outer valve needle on the end toward the combustion chamber.

In a further advantageous feature, by means of a radial enlargement of the inner bore, a pressure vessel is formed in the outer valve needle, in which the pressure face of the inner valve needle is disposed and which can be made to communicate with the pressure chamber through the throttle connection. As a result of the embodiment of the pressure vessel, the size of the pressure face of the inner valve needle can be adjusted within wider ranges to obtain the desired opening force. It is also advantageous in this embodiment to provide a counterpart pressure face in the pressure vessel on the outer valve needle that is subjected to the fuel pressure in the pressure vessel and is oriented counter to the valve sealing face of the outer valve needle. This has the advantage that in the opening stroke motion of the outer valve needle, the full fuel pressure of the pressure chamber contacts the valve sealing face of the outer valve needle, while a lesser pressure still prevails in the pressure vessel, so that no counterpressure on the counterpart pressure face is produced. Conversely, in the closing motion, the injection pressure of the pressure chamber has built up in the pressure vessel, so that the counterpart pressure face of the outer valve needle is acted upon, and the hydraulic force on the valve sealing face of the outer valve needle is partly compensated for. As a result, the force on the outer valve needle in the opening direction is reduced, which speeds up the closing motion of the outer valve needle and thus decisively shortens the switching time.

In a further advantageous feature of the subject of the invention, a return conduit is embodied between the wall of the inner bore and the inner valve needle and discharges into a leak fuel chamber, embodied in the fuel injection valve, in which a low fuel pressure prevails. Via this return conduit, the pressure vessel can be relieved in a simple way, so that once the injection has ended, the fuel pressure in the pressure vessel drops to the pressure of the leak fuel chamber.

Further advantages and advantageous features of the subject of the invention can be learned from the description and the drawings.

BRIEF DESCRIPTION OF THE DRAWINGS

A fuel injection valve of the invention is shown in the drawings.

DETAILED DESCRIPTION OF THE PREFERRED EMBODIMENTS

Figure 1:
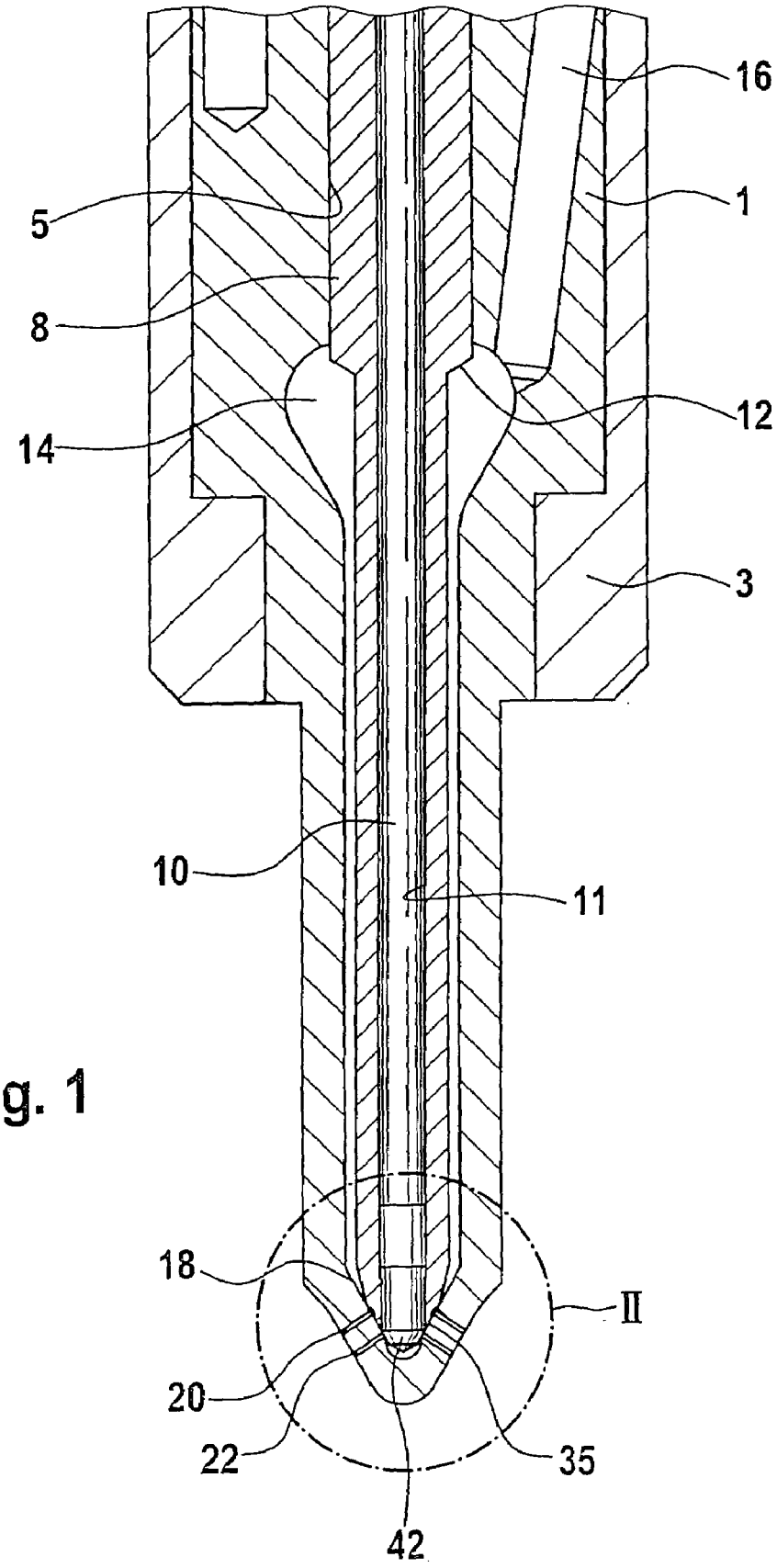
FIG. 1 shows a fuel injection valve in longitudinal section.

In FIG. 1, a fuel injection valve of the invention is shown in longitudinal section. The fuel injection valve has a valve body 1, which is pressed against a valve holder body, not shown in the drawing, by means of a tensioning nut 3. A bore 5 is embodied in the valve body 1 and is defined on its end toward the combustion chamber by a conical valve seat 18.

A first row of injection openings 20 and a second row of injection openings 22, the latter located toward the combustion chamber, originate at the valve seat 18. In the installed position of the fuel injection valve in the engine, both rows of injection openings 20, 22 discharge into the combustion chamber of the engine. A pistonlike outer valve needle 8 is located in the bore 5 and is guided in the bore 5 in a portion facing away from the combustion chamber. Toward the valve seat 18, the outer valve needle 8 tapers, forming a pressure shoulder 12, and at its end toward the combustion chamber it merges with a sealing face 25. A pressure chamber 14 is embodied between the outer valve needle 8 and the wall of the bore 5 and is radially enlarged at the level of the pressure shoulder 12. An inlet conduit 16 extending in the valve holder body 1 discharges into the radial enlargement of the pressure chamber 14 and delivers fuel from a high-pressure fuel source to the pressure chamber 14 at high pressure. The outer valve needle 8 has an inner bore 11, in which an inner valve needle 10 is guided longitudinally displaceably. The inner valve needle 10, on its end toward the combustion chamber, has a sealing face 42, with which it, like the outer valve needle 8 with its sealing face 35, rests on the valve seat 18. The outer valve needle 8 and the inner valve needle 10 are each acted upon separately on their respective ends facing away from the combustion chamber by a closing force that presses the respective valve needle 8, 10 in the direction of the valve seat 18. The closing force here may be generated for instance via springs or via hydraulic devices.

Figure 2:
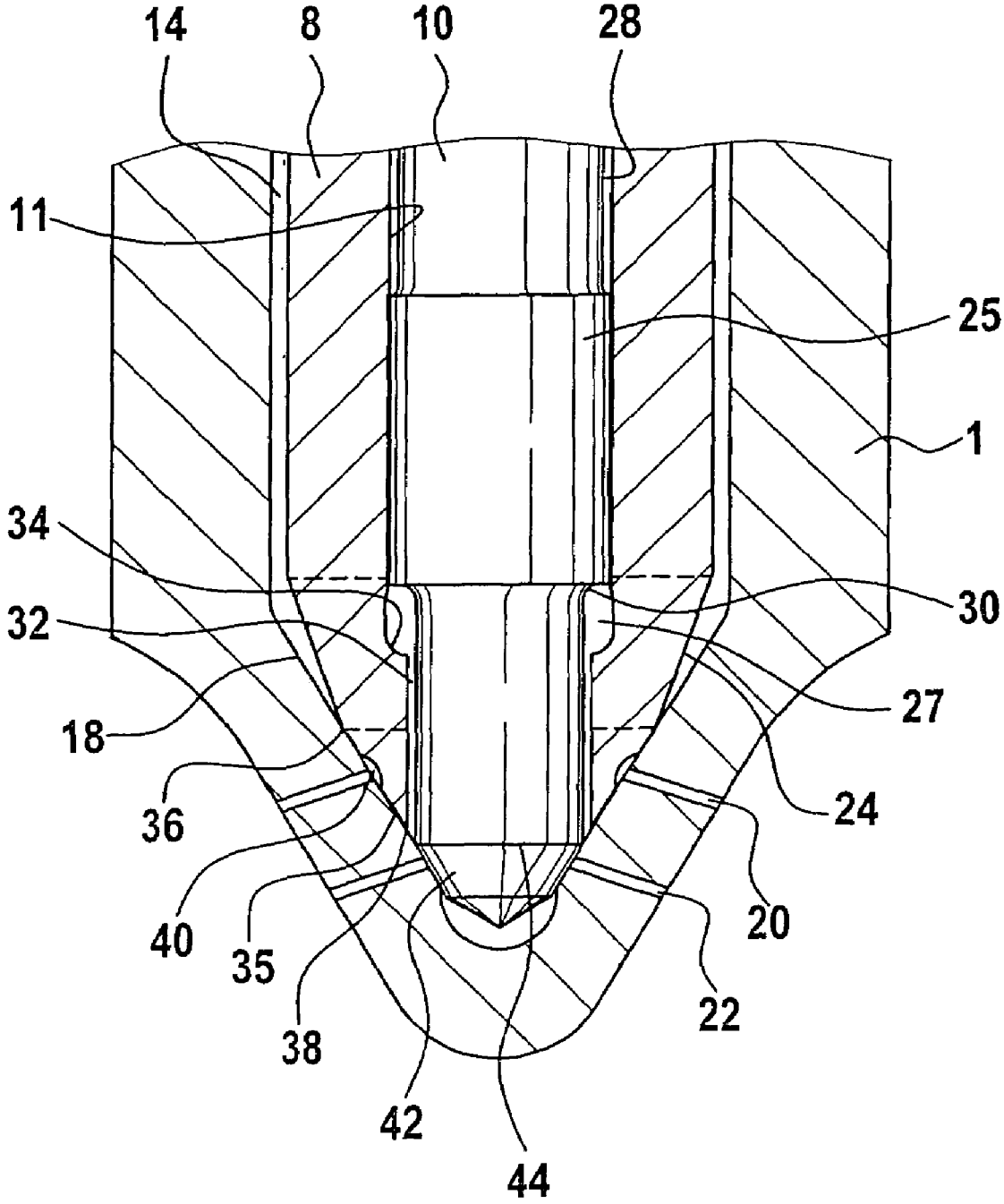
FIG. 2 shows an enlargement of the detail marked II in FIG. 1 in the region of the valve seat.
Figure 3:
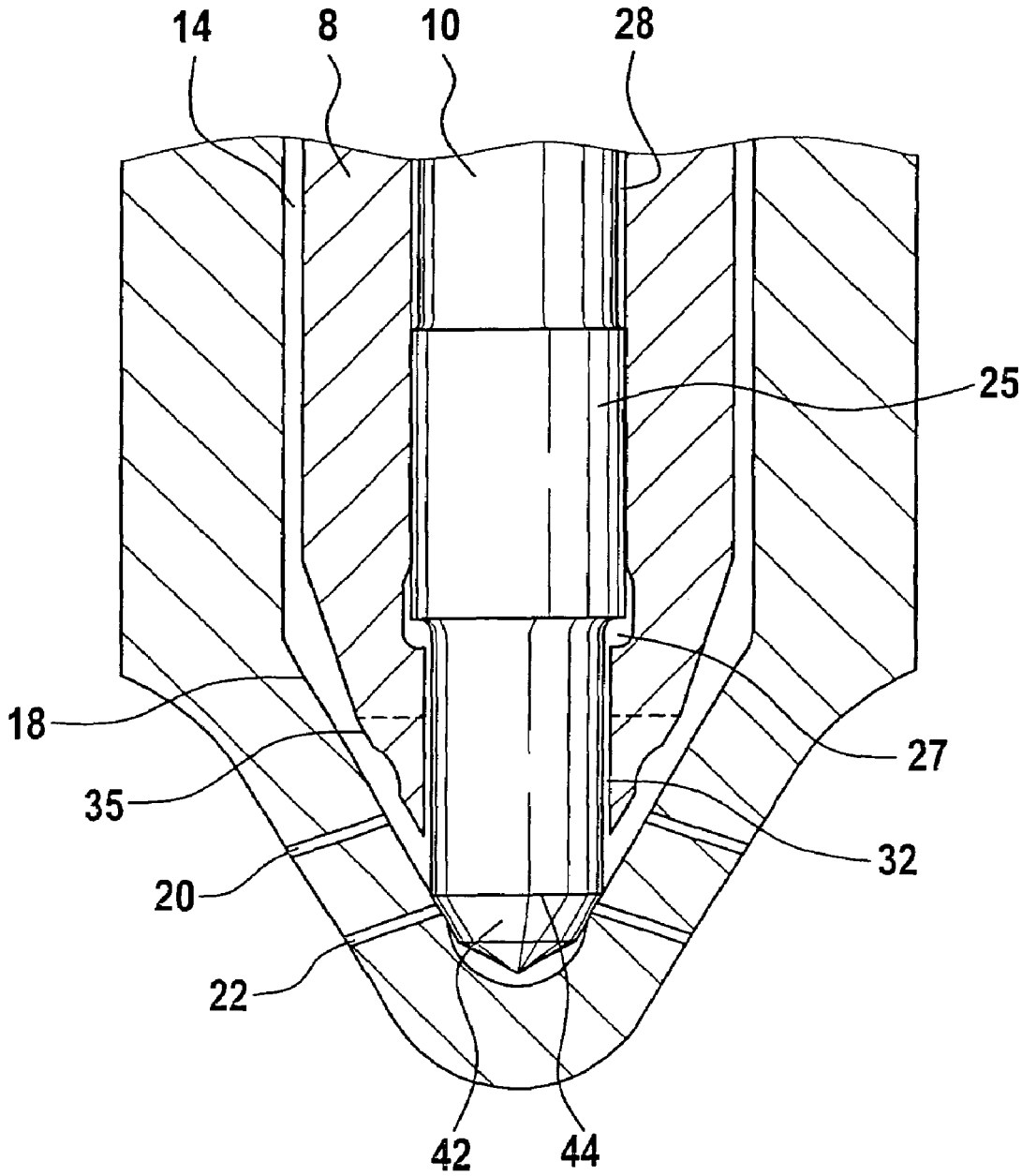
FIG. 3 and FIG. 4 show the same detail as FIG. 2, in different phases of the fuel injection valve.

In FIG. 2, an enlargement of the detail marked II in FIG. 1 is shown. The outer valve needle 8, on its end toward the combustion chamber, has a conical face 24 and adjoining it a likewise conical valve sealing face 35. By means of the different opening angles of the conical face 24 and valve sealing face 35, a first sealing edge 36 is formed at the transition between them, which serves to seal off the pressure chamber 14 from the first row of injection openings 20 when the outer valve needle 8 rests on the valve seat 18. The conical valve sealing face 35 has an opening angle that is slightly smaller than the opening angle of the conical valve seat 18. As a result, upon the closing motion of the outer valve needle 8 onto the valve seat 18, the end toward the combustion chamber of the valve sealing face 35 comes to rest on the valve seat 18 first, and this end is embodied as a second sealing edge 38. Not until a slight deformation of the valve sealing face 35 has occurred does the first sealing edge 36 also come to rest on the valve seat 18, so that the first row of injection openings 20 is sealed off from both the pressure chamber 14 and the region of the valve seat 18 located downstream of the first row of injection openings 20. To assure a sufficient contact pressure at the first sealing edge 36 and the second sealing edge 38, an annular groove 40, which extends at the level of the first row of injection openings 20, is embodied on the valve sealing face 35 between these two sealing edges 36, 38. The depth of the annular groove 40 is slight, because a large volume in this region has an unfavorable effect on hydrocarbon emissions from the engine.

The inner valve needle 10 is located with a certain amount of play in the inner bore 11, so that between the inner valve needle 10 and the wall of the inner bore 11, a return conduit 28 is embodied, which has a circular-annular cross section and which discharges, at the end of the valve needles 8, 10 facing away from the combustion chamber, into a leak fuel chamber, not shown in the drawing, in which a low fuel pressure always prevails.

In the end region toward the combustion chamber, the inner valve needle 10 has a guide portion 25, which represents a radial enlargement of the inner valve needle 10 and assures guidance of the inner valve needle 10 in the inner bore 11. Toward the end of the inner valve needle 10 toward the combustion chamber, the guide portion 25 tapers, forming a pressure shoulder 30, and at the end toward the combustion chamber it changes into a conical sealing face 42. At the transition from the inner valve needle 10 to the sealing face 42, an encompassing sealing edge 44 is embodied, which comes to rest on the conical valve seat 18 when the inner valve needle is resting on that valve seat. As a result, the second row of injection openings 22 is closed off from the pressure chamber 14, so that no fuel can emerge from the second row of injection openings 22.

The inner bore 11 of the outer valve needle 8 tapers toward its end toward the combustion chamber, forming an annular shoulder 34 which is located such that it is diametrically opposite the pressure shoulder 30 of the inner valve needle 10. A pressure vessel 27 is defined by the pressure shoulder 30, the annular shoulder 34, the wall of the inner bore 11, and the valve needle 10 and communicates with the valve seat 18 via an annular gap 32; the annular gap 32 extends between the inner valve needle 10 and the inner bore 11. Via a residual gap 48 between the guide portion 25 and the wall of the inner bore 11, the pressure vessel 27 moreover communicates in throttled fashion with the return conduit 28.

Figure 4:
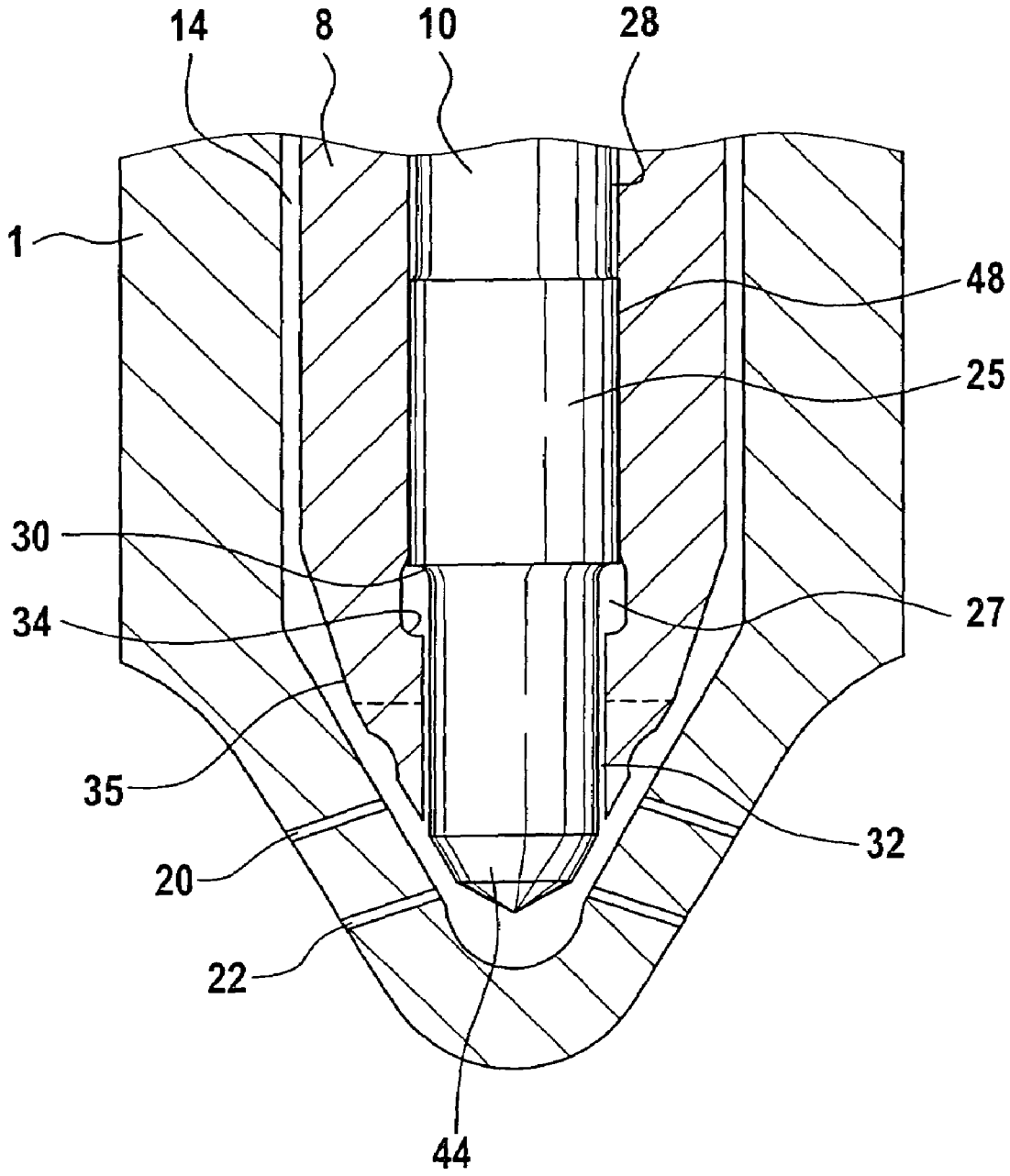

The mode of operation of the fuel injection valve is as follows: In fuel injection systems that operate on what is known as the common rail principle, a high fuel pressure, which is equivalent to the injection pressure, always prevails in the pressure chamber 14. A closing force acts on both the outer valve needle 8 and the inner valve needle 10 that is great enough that both valve needles 8, 10 are kept in contact with the valve seat 18, and as a result the rows of injection openings 20, 22 are closed. In the fuel injection valve of the invention, first only some of the fuel injection openings are opened, and only in the further course of the injection are all the injection openings opened. To that end, the closing force on the outer valve needle 8 is reduced, so that the hydraulic force on the pressure shoulder 12 and on the conical face 24 of the outer valve needle 8 is greater than the closing force. As a result, the outer valve needle 8 moves away from the valve seat 18, so that fuel can now flow out of the pressure chamber 14 to the first row of injection openings 20, and from there the fuel is injected into the combustion chamber of the engine. The inner valve needle 10 is kept in its closing position by the closing force and by the absence of a suitable opening force. As a result of the lifting of the outer valve needle 8 from the valve seat 18, the fuel now also flows through the annular gap 32 into the pressure vessel 27; the annular gap 32 throttles to such an extent that the pressure increase in the pressure vessel 27 takes place only with a certain delay. As the fuel pressure in the pressure vessel 27 increases, a hydraulic force on the pressure shoulder 30 builds up that is oriented counter to the closing force on the inner valve needle 10. As soon as the hydraulic force on the pressure shoulder 30 exceeds the closing force on the inner valve needle 10, the inner valve needle 10 also opens and with its sealing edge 44 lifts from the valve seat 18, so that now fuel is also injected into the combustion chamber through the second row of injection openings 22. This opened state, which is shown in FIG. 4, is maintained until such time as the desired fuel quantity has been injected into the combustion chamber. For closing the fuel injection valve, the closing forces on the inner valve needle 10 and the outer valve needle 8 are increased until these closing forces are higher than the hydraulic forces from the fuel pressure in the pressure chamber 14. Both the outer valve needle 8 and the inner valve needle 10 slide back into their closing position on the valve seat 18 and close both rows of injection openings 20, 22 again. Upon seating of the outer valve needle 8 on the valve seat 18, the second sealing edge 38 comes to rest on the valve seat 18 first, and after that the first sealing edge 36 does the same, so that the first row of injection openings 20 is sealed off from both the pressure chamber 14 and the second row of injection openings 22. After the outer valve needle 8 has become seated on the valve seat 18, the pressure vessel 27 is disconnected from the pressure chamber 14. The still-high fuel pressure in the pressure vessel 27 is now gradually relieved through the throttle gap between the guide portion 25 and the wall of the inner bore 11 via the return conduit 28, so that the low fuel pressure of the leak fuel chamber is established in the pressure vessel 27, until the next injection by the fuel injection valve takes place.

The embodiment of the pressure vessel 27 has still another advantage beyond this. The opening speed of the outer valve needle 8 depends not only on the mass of the outer valve needle 8 but also on the forces engaging it; that is, given a closing force, it depends on the area of the surface of the outer valve needle 8 acted upon by the pressure. At the onset of the opening stroke motion, this means the pressure shoulder 12 and the conical face 24. If the outer valve needle 8 has lifted from the valve seat 18, then the hydraulic force on the sealing face 35 comes into play as well. The annular shoulder 34 counteracts this only very slightly, since at the onset of the opening stroke motion the fuel pressure in the pressure vessel 27 is only slight, making this force negligible. The outer valve needle 8 therefore opens very fast, which is indispensable for injections in rapid succession. Upon termination of the injection, a high fuel pressure prevails in the pressure vessel 27 and now also exerts a corresponding hydraulic force on the annular shoulder 34. This force partly compensates for the hydraulic force on the sealing face 35, so that the now further-increased closing force on the outer valve needle 8, because of the lesser contrary force, moves the outer valve needle 8 faster back into its closing position, thereby also speeding up the closing motion. Because of the faster opening and closing of the outer valve needle 8, injections in rapid succession can be achieved without problems. Because of the pressure shoulder 30 of the inner valve needle 10, which shoulder is spaced apart from the valve seat 18, it moreover becomes possible to reinforce the outer valve needle 8 in the region of the sealing face 35, thus reducing wear because of a larger area of contact between the outer valve needle 8 and the valve seat 18.

Figure 5:
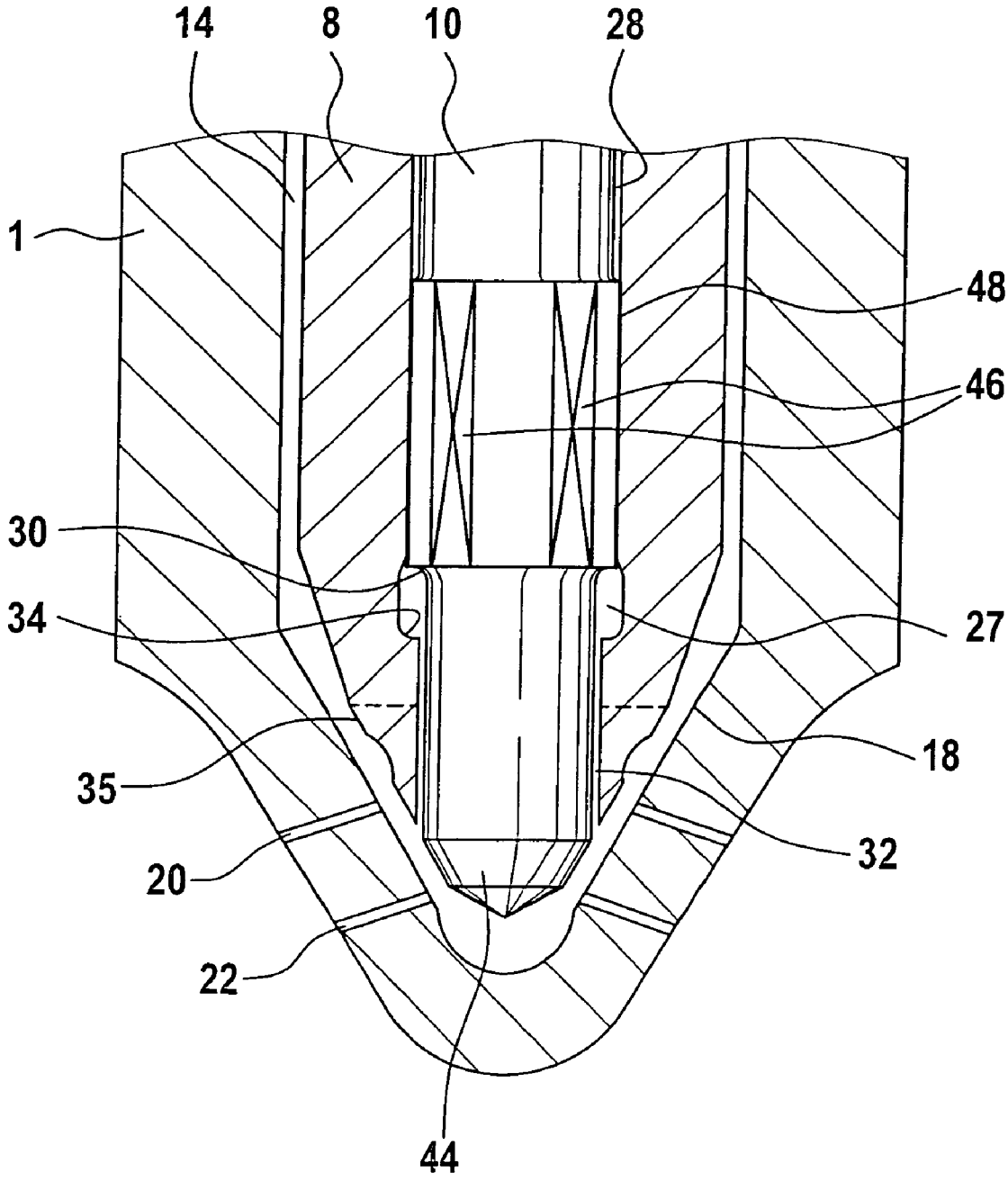
FIG. 5 shows the same view as FIG. 4 for a modified exemplary embodiment.

FIG. 5 shows the same view as FIG. 4, for a further exemplary embodiment. The communication of the pressure vessel 27 with the return conduit 28 here is produced not, or not only, via the residual gap 48 embodied between the guide portion 25 and the wall of the inner bore 11, but instead or also via a plurality of polished sections 46, embodied laterally on the guide portion 25. By means of these polished sections 46, the flow cross section can be optimized to attain a rapid pressure drop after the termination of the injection and simultaneously to assure precise guidance of the inner valve needle 10 in the inner bore 11. The polished sections 46 here are embodied only shallowly, preferably with a depth of 5 to 20 μm. The residual gap 48 can be selected to be arbitrarily small, as long as excessive friction does not occur between the inner valve needle 10 and the wall of the inner bore 11, since the flow of fuel is assured via the polished sections 46. So that as before, a pressure buildup will occur in the pressure vessel 27, the flow cross section of the polished sections 46 is less than the flow cross section of the annular gap 32.

The invention claimed is:

1. A fuel injection valve for internal combustion engines, having a valve body (1) in which a bore (5) that is defined on its end toward the combustion chamber by a valve seat (18) is embodied, in which valve seat a first row of injection openings (20) and a second row of injection openings (22) are embodied, and the second row of injection openings (22) is closer to the combustion chamber than the first row of injection openings (20), and having an outer valve needle (8), which is located longitudinally displaceably in the bore (5) and which cooperates with the valve seat (18) to control the first row of injection openings (20), and between the outer valve needle (8) and the wall of the bore (5), a pressure chamber (14) is embodied that can be filled with fuel at high pressure, and having an inner valve needle (10), which is located longitudinally displaceably in an inner bore (11) of the outer valve needle (8) and which cooperates with the valve seat (18) for controlling the second row of injection openings (22), and having a pressure shoulder (30), embodied on the inner valve needle (10), by way of which shoulder, upon subjection to pressure, a hydraulic opening force is exerted on the inner valve needle (10), characterized in that the outer valve needle (8), as a result of its opening stroke motion, opens a throttle connection (32) from the pressure chamber (14) to the pressure shoulder (30) of the inner valve needle (10), wherein the throttle connection is embodied as an annular gap (32) between the wall of the inner bore (11) and the inner valve needle (10), and wherein in the outer valve needle (8), by means of a radial enlargement of the inner bore (11), a pressure vessel (27) is formed in which the pressure shoulder (30) of the inner valve needle (10) is located, and which can be made to communicate with the pressure chamber (14) by the throttle connection (32).

2. The fuel injection valve according to claim 1, wherein the pressure vessel (27) is defined by an annular shoulder (34) of the outer valve needle (8) that is oriented counter to the valve sealing face (35) of the outer valve needle (8).

3. The fuel injection valve according to claim 1, wherein the inner valve needle (10), near the valve seat (18), has a guide portion (25) with which it is guided in the inner bore (11).

4. The fuel injection valve according to claim 3, wherein facing away from the combustion chamber toward the guide portion (25) of the inner valve needle (10), a return conduit (28) is embodied between the wall of the inner bore (11) and the inner valve needle (10), by way of which conduit the pressure chamber (27) can be pressure-relieved.

5. The fuel injection valve according to claim 4, wherein at least polished section (46) embodied on the guide portion (25) of the inner valve needle (10).

6. The fuel injection valve according to claim 4, wherein the pressure shoulder (30) of the inner valve needle (10) is embodied on the end toward the combustion chamber of the radially enlarged guide portion (25).

* * * * *